US006823630B2

(12) United States Patent
Marra

(10) Patent No.: US 6,823,630 B2
(45) Date of Patent: Nov. 30, 2004

(54) EAVES TROUGH ASSEMBLY WITH STEPPED DOWN SHIELD

(75) Inventor: Michael J. Marra, West Babylon, NY (US)

(73) Assignee: Michael J. Marra, Inc., West Babylon, NY (US)

( * ) Notice: Subject to any disclaimer, the term of this patent is extended or adjusted under 35 U.S.C. 154(b) by 0 days.

(21) Appl. No.: 10/417,817

(22) Filed: Apr. 17, 2003

(65) Prior Publication Data

US 2004/0206010 A1 Oct. 21, 2004

(51) Int. Cl.[7] ..... E04D 13/00
(52) U.S. Cl. ..... 52/11; 52/12; 248/48.1
(58) Field of Search ..... 52/11, 12; 248/48.1

(56) References Cited

U.S. PATENT DOCUMENTS

| | | | | | |
|---|---|---|---|---|---|
| 836,012 | A | | 11/1906 | Cassen | |
| 2,533,402 | A | | 12/1950 | Schmitz | |
| 2,672,832 | A | * | 3/1954 | Goetz | 52/12 |
| 2,873,700 | A | | 2/1959 | Heier | |
| 3,079,000 | A | | 2/1963 | Volsi | |
| 3,507,396 | A | | 4/1970 | Homa | |
| 4,404,775 | A | | 9/1983 | Demartini | |
| 4,406,093 | A | | 9/1983 | Good et al. | |
| 4,455,791 | A | | 6/1984 | Elko et al. | |
| 4,493,588 | A | | 1/1985 | Duffy | |
| 4,497,146 | A | * | 2/1985 | Demartini | 52/12 |
| 4,551,956 | A | | 11/1985 | Axford | |
| 4,571,896 | A | | 2/1986 | Condie | |
| 4,590,716 | A | | 5/1986 | Smith | |
| 4,592,174 | A | | 6/1986 | Hileman | |
| 4,757,649 | A | | 7/1988 | Vahldieck | |
| 4,858,396 | A | | 8/1989 | Rose et al. | |
| 4,866,890 | A | | 9/1989 | Otto | |
| 4,876,827 | A | | 10/1989 | Williams | |
| 5,242,591 | A | | 9/1993 | Beechert et al. | |
| 5,327,689 | A | | 7/1994 | Jansen | |
| 5,332,332 | A | | 7/1994 | Kenyon, Jr. | |
| 5,375,379 | A | * | 12/1994 | Meckstroth | 52/12 |
| 5,388,377 | A | * | 2/1995 | Faulkner | 52/11 |
| 5,406,754 | A | | 4/1995 | Cosby | |
| 5,406,755 | A | | 4/1995 | Serano | |
| 5,459,965 | A | | 10/1995 | Meckstroth | |
| 5,522,183 | A | | 6/1996 | Allen | |
| 5,575,118 | A | | 11/1996 | Vahldieck | |
| 5,737,879 | A | * | 4/1998 | Sweet | 52/12 |
| 5,893,240 | A | * | 4/1999 | Ealer, Sr. | 52/12 |
| 5,911,659 | A | | 6/1999 | Serano | |
| 6,073,398 | A | * | 6/2000 | Williams | 52/12 |
| 6,672,012 | B2 | * | 1/2004 | Bahroos et al. | 52/11 |
| 6,681,527 | B2 | * | 1/2004 | Baker | 52/12 |

* cited by examiner

*Primary Examiner*—Peter M. Cuomo
*Assistant Examiner*—Stephanie Harris
(74) *Attorney, Agent, or Firm*—James S. Finn

(57) ABSTRACT

A rain gutter system comprising: a gutter having a trough for receiving water formed by a front wall, a bottom wall and back wall, and a shield, said shield having an exterior edge, a top portion and an interior section integrally formed with the rear wall, said shield covering at least a portion of the trough to prevent debris from entering the trough, and said shield terminating at said exterior edge in a downwardly and rearwardly curved fashion, wherein a gap is provided between a lower end of said downwardly and rearwardly curved section of said shield and the front wall; wherein said shield has at least one step down portion positioned at point or points on said top portion of said shield; and at least one connecting means for connecting said gutter, said at least one connecting means passing through said at least one step down portion and through said rear wall into the structure to which it is attached.

16 Claims, 5 Drawing Sheets

EAVES TROUGH ASSEMBLY WITH STEPPED DOWN SHIELD

BACKGROUND OF THE INVENTION

1. Field of the Invention

This invention relates generally to rain gutters for buildings and other structures, and in particular is concerned with an eaves trough assembly with a unique shield portion that deflects debris and blocks it from falling into a trough of the gutter and enabling significantly improved water flow characteristics and easing installation tremendously.

2. Background of the Invention and Related Art

The use of shields on rain gutters is well known and a variety of shields and shield mounting systems are available. Shields manufactured from a single piece which either snap into a gutter or are integral to the gutter are provided in, for example, U.S. Pat. Nos. 5,911,659; 5,737,879 and 5,575,118. Gutter shields which are pre-formed and snap into a gutter are undesirable since gutters are available in many cross-sectional shapes and sizes and the installer must maintain an inventory of parts or not participate in some business opportunities.

Gutter shields which can be added to existing gutters are provided in, for example, U.S. Pat. Nos. 4,455,791; 4,404,775 and 5,459,965. These typically include an elongated flat cover with one end placed under the shingles of the house and the other end rolled under and secured to the gutter. The manner in which these devices are secured is deficient for a variety of reasons. U.S. Pat. No. 4,455,791 teaches a series of straps which are on top of the gutter shield. The gutter shield rest on the spikes which secure the gutter to the building. This is unsightly and requires that spikes be used to secure the gutter to the building. Spikes are not always appropriate. U.S. Pat. No. 4,455,791 also teaches an embodiment wherein a clip secures the gutter shield to the gutter. This method is not secure and wind can dislodge the gutter shield which is undesirable.

Modern gutters can be formed by bending a coiled strip of material to a desired profile and cutting the strip to a desired length. Popular materials for gutters include aluminum, copper and steel. A strip can be bent by a machine having a series of rollers to produce the desired profile. Such a machine is commonly referred to as a rollformer.

Leaves and other debris fall may into the open trough of a gutter. As such foreign matter accumulates in a gutter, it can tend to clog a gutter and prevent the free flow of water. To combat this problem, screens and guards adapted to be mounted on an open gutter have been developed. Such screens can be mounted on a gutter by fasteners and clips or can be positioned between front and back walls of a gutter and retained by front and rear edges which engage respective walls. Gutters with integrally formed shields have been used prevent debris from falling into troughs. Examples of such gutters can be seen in U.S. Pat. Nos. 4,757,649 and 5,575,118 (also mentioned above).

The art continues to seek improvements. It is desirable to from a gutter system which is economical to manufacture, easy to install, and prevents debris from falling into a trough. Furthermore, it is desirable to provide a supported gutter which will not collapse and fail due to heavy debris such as snow and ice.

There are several patented designs of shielded eaves troughs and brackets for supporting them on a building, some of which are described in the patents discussed below.

U.S. Pat. No. 4,757,649, discloses an integral gutter and leaf shield in which the shield is formed with a double-curved convolute to direct rain into the trough. The integral shield and gutter is fastened to the wall beneath the roof by a fastener which passed through the integral back wall to the building wall.

U.S. Pat. No. 836,012, patented by G. Cassen, Nov. 13, 1906, describes a trough having a back wall that is higher than the front wall. A separate shield which extends from the top of the back wall slopes forward and downward. The front of the shield turns downward, ending just rearward of the top edge of the front wall. A pair of brace straps attach the shield and trough to the building at intervals along the length of the trough.

One of the braces is a strap attached at one end to the top of the front of the shield, and at the other end to the top of the roof. The other brace is a bar attached at one end to the back wall of the trough by a screw which passes through the bar, the trough wall and the vertical side wall of the building. The other end of the bar is bifurcated to provide an upturned and a downturned attachment tab. The upturned tab is attached to the front end of the shield, and the downturned tab is attached to the trough by the top edge of the front wall.

U.S. Pat. No. 2,672,832, patented Mar. 23, 1954 by A. K. Goetz, describes a trough having a back wall higher than the front wall. The top of the back wall has a V-shaped longitudinal, horizontally arranged groove. The rear edge of the shield has a matching groove so that the rear edge can seat on the back wall groove. A pair of nails attach the shield and trough, respectively, to the building. The first nail has a threaded back end and passes through the back wall and into the vertical side wall of the building. A screw which passes through the downward turned front of the shield engages the threaded back end of the nail and forces the shield toward the building wall so that the shield is seated on the back wall groove. The nail arrangement is repeated at intervals along the length of the shield and trough assembly.

U.S. Pat. No. 2,873,700, patented Feb. 17, 1959 by H. C. Heier, describes a trough having a back wall that is higher than the front wall. A generally flat rearward section of the shield extends forward from the top of the back wall. Angling slightly downward, it extends forward of the front wall and ends just rearward of the front wall. The ends of the trough and shield sections are interconnected by brackets which are fastened to the wall of the building by screws. A series of the spacers along the length of the shielded trough assembly provides slot openings to the trough for receiving water that moves down over the shield. The front end of the shield is fastened to the top of the front wall of the trough by way of a screw through the shield, through a wedge-shaped spacer between the shield and front wall and through the front wall.

U.S. Pat. No. 4,493,588, patented by G. Duffy, Jan. 15, 1985, describes a trough having a back wall which is nailed to a roof under the shingles, extends forward and down from the roof in a curve that then turns back under the eaves, whereupon the wall reverses direction and forms a suspended trough, the front wall of which has a screen that contacts the front of the curved back wall just below the forward most part of the curve, so that water flowing down over the curve enters the trough via the screen.

U.S. Pat. No. 4,497,146, patented Feb. 5, 1985 by R. Demartini, describes a support strap having one end resting on the roof of the building. In juxtaposed support with the underside of a separate shield which is retrofitted on already installed gutters. The strip extends forward from the roof until it is about parallel with the front wall of the trough. The strip then curves back with the shield until it reaches the bottom end of the shield, whereupon the strip continues downward and is fastened to the upper part of the front wall of the trough, in order to support the shield on the trough. It is fastened to the trough either directly by a fastener or indirectly by attachment to the ferrule of a horizontal bolt that passes through the front and back walls of the trough normal to the back wall of the trough and into the vertical side wall of the building.

As mentioned above and elaborated here, U.S. Pat. No. 4,757,649 to Vahldiek discloses a gutter system in which an upper shield is provided in the form of a continuous double-curved convolute curve. The shield allows leaves and debris present in the runoff from the roof to be directed away from the gutter, the rainwater itself traveling along the curve of the shield to be deposited in the gutter. Although such a device may be somewhat successful in preventing leaves in the runoff from entering the gutter, the gutter remains susceptible to clogging with blowing leaves and other such debris that enter through the large gap between the shield and the gutter. Another approach to the prevention of clogged gutter is shown in U.S. Pat. No. 5,406,755 to Serano and U.S. Pat. No. 4,404,775 to Demartini. These patents teach the use of a deflector having an arcuate surface that moves leaves included in roof runoff away from the gutter, and limits the size of the gap between the deflector and the gutter. The deflectors of these patents, however, are separate from the gutter, and require mounting beneath the roof shingles which makes retrofitting difficult. Further, the narrowed gap between the deflector and the gutter prevents the periodic cleaning of small debris from the gutter. Such small debris can accumulate and eventually clog the gutter.

Other prior art attempts at providing means for preventing the clogging of a roof gutter and attaching the gutter to a connecting wall are described in, for example, U.S. Pat. Nos. 5,522,183; 5,406,754; 5,388,377; 5,332,332; 5,327,689; 5,242,591; 4,876,827; 4,866,890; 4,858,396; 4,592,174; 4,590,716; 4,571,896; 4,551,956; 4,406,093; 3,507,396; 3,079,000; 3,507,396; and 2,533,402, as well as German Patent No. 1,509,127.

Significant problem exists with all of the methods described above for attaching the gutter to the connecting wall or roof. Regarding attaching the trough with screws through the front of the shield and by the other means described above. The first is that because the screw or nail must pass through the front of the shield, it necessarily must be the distance of the shield or trough from the wall it is connected to. When weight from rain, snow or ice is placed up the gutter, the torque caused by such a long moment arm (i.e., the distance from the connecting point on the wall to the connecting point on the gutter) on the gutter often times cause the gutter to collapse. The second problem is that, as described in the above patents, the curved portion of the shield is where the water flows into the trough portion. This happens because of the laminar flow of the water and surface friction between the water and the bullnose section of the shield. When the gutter is attached at the front portion of the shield (the portion again where the water flows around), it interrupts the laminar flow of the water and causes the water to break away from the curved portion and therefore not be directed into the trough. A third problem is installation. Although it may not seem like a big difference in distance from the connecting wall to the end of the shield, when working from a roof and trying to reach out over the trough to hammer in a nail or screw in a screw, it would be very advantageous to be closer to the wall to which the gutter is attached. A fourth problem with installing the gutter at the end portion of the is that due to the distance between the end of the shield and the front and the curved shape of the shield, when nails are hammered into the front it can bend the shield itself.

Regarding other means which require the attaching of the gutter by the back wall, it is extremely difficult to attach the gutter in such a way because of the difficulty of applying force to the attaching means (for example, the screw or nail) between the end of the shield and the upper portion of the trough. Other methods which require brackets and the like are expensive to manufacture, very difficult to install and are many times an ineffective means of support.

Finally, supporting the rain gutter directly in a rear wall which abuts the structure to which it is attached is difficult because you have to apply force to the securing means typically through a small gap.

Thus, a long felt need in the art is present for a rain gutter that provides a shielded portion to prevent debris from entering the trough but yet is still easy to install, provides strong support, improves water flow and is inexpensive to manufacture.

SUMMARY OF THE INVENTION

In light of the above problems in the art, it is an object of the present invention to provide a one-piece gutter with a shielded portion that has a step down section enabling improved water flow to the bull-nose section of the shield.

It is another object of the present invention to provide a one-piece gutter with a shielded portion that has a step down section enabling ease of installation on the connecting wall or roof to which it is attached.

It is yet another object of the present invention to provide a one-piece gutter with a shielded portion that has a step down section enabling ease of manufacture due to its unibody construction.

It is yet another object of the present invention to provide a shield that has a step down section that can be placed above an existing eaves trough which does not have a pre-existing shield above it.

It is yet another object of the present invention to provide a shield that can have multiple step down sections on said shield.

These and other features, as will be apparent, are provided in a gutter system comprising: a gutter having a trough for receiving water formed by a front wall, a bottom wall and back wall, and a shield, said shield having an exterior edge, a top portion and an interior section integrally formed with the rear wall, said shield covering at least a portion of the trough to prevent debris from entering the trough, and said shield terminating at said exterior edge in a downwardly and rearwardly curved fashion, wherein a gap is provided between a lower end of said downwardly and rearwardly curved section of said shield and said front wall; wherein said shield has at least one step down portion positioned at point or points on said top portion of said shield; and at least one connecting means for connecting said gutter, said at least one connecting means passing through said at least one step down portion and through said rear wall into the structure to which it is attached.

Various objects and advantages of this invention will become apparent to those skilled in the art from the following detailed description of the preferred embodiment, when read in light of the accompanying drawings.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE EMBODIMENTS

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in art. Like numbers refer to like elements throughout.

Figure 1:
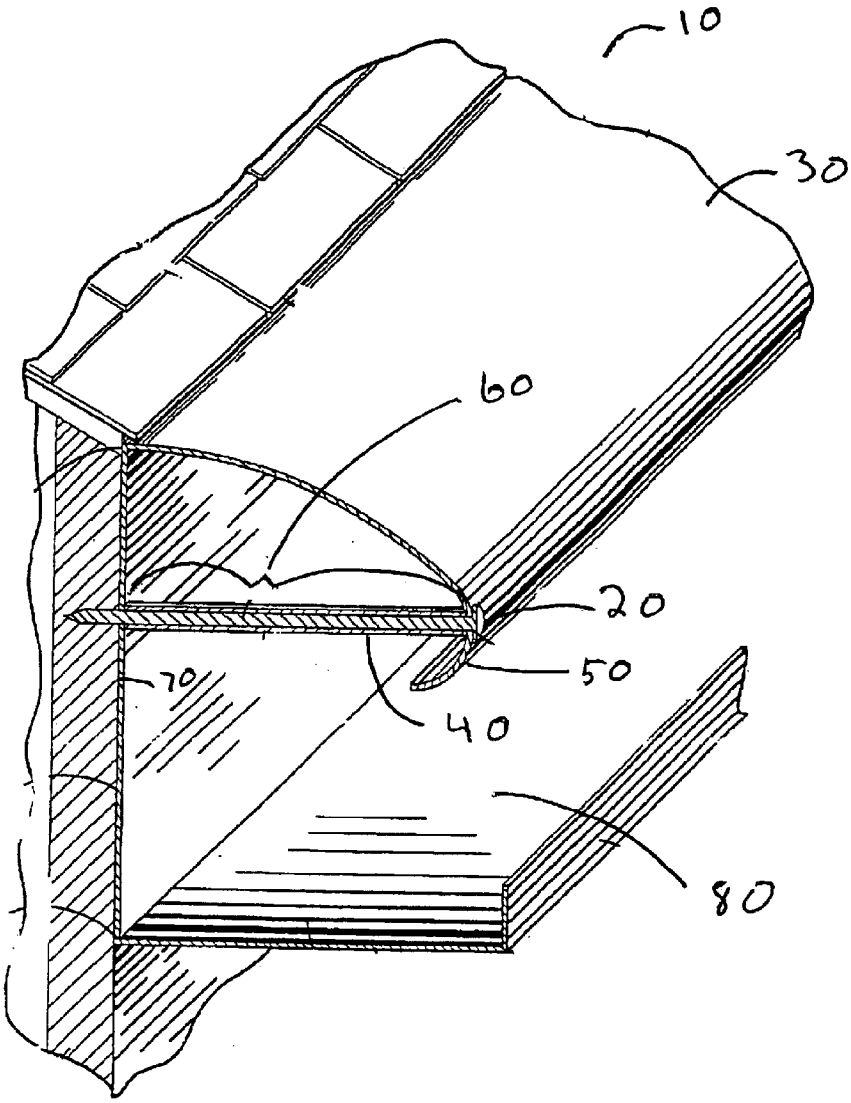
FIG. 1 (PRIOR ART)
FIG. 1 is a perspective view of a prior art gutter system depicting previous methods of connecting the rain gutter to a structure.

FIG. 1 depicts a prior art raingutter 10, with their attaching means 20 on protective shield 30. As can be shown, the attaching means 20, herein, is a nail or screw 40 and is attached at the front portion 50 of the protective shield 30. As can be seen by distance (also considered moment arm) 60 between back portion 70 of the trough 80 which connects to a connecting wall or roof (not shown) is significant and if weight is placed in the trough, the torque caused by such a long moment arm 60 will make the rain gutter susceptible to detaching or bending.

Figure 2:
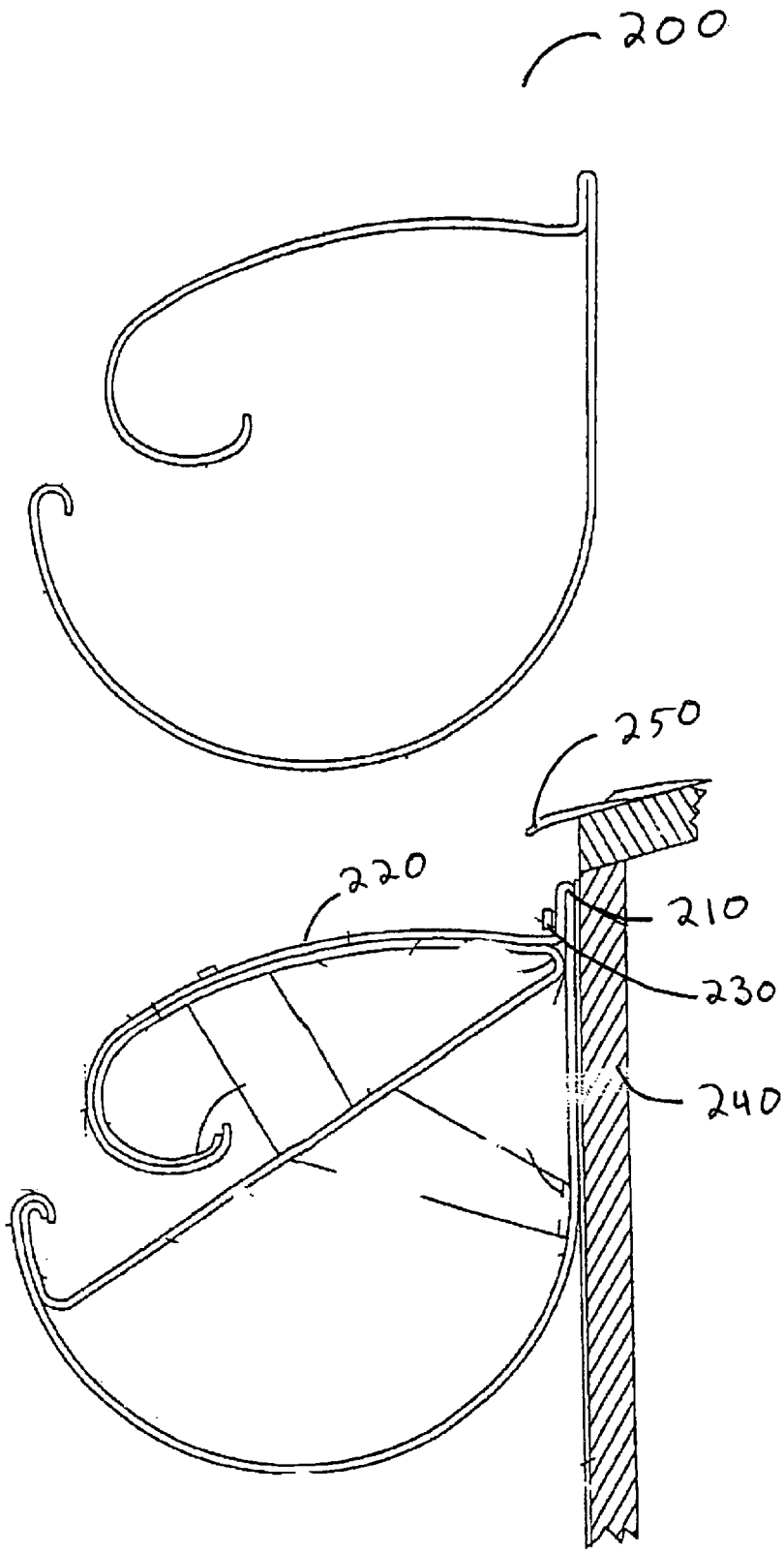
FIG. 2 (PRIOR ART)
FIG. 2 is a perspective view of another prior art gutter system depicting another previous methods of connecting the rain gutter to a structure.

FIG. 2 depicts another prior art rainguter 200 with attaching means 210 on protective shield 220. Although no long moment arm is present in this rain gutter, it is very difficult to attach affixing means (such as nail or screw) to the structure 240 to which it is attached. Much experience has shown that trying to screw or hammer in with this placement is very difficult. If on is trying to attach from the roof, it is very difficult to reach under the shingle or roof tile 250 to reach the affixing means. If attaching from a ladder from beneath the rain gutter, the shield 220 makes using a hammer or screw very difficult because the affixing means is so hard to get to.

Figure 3:
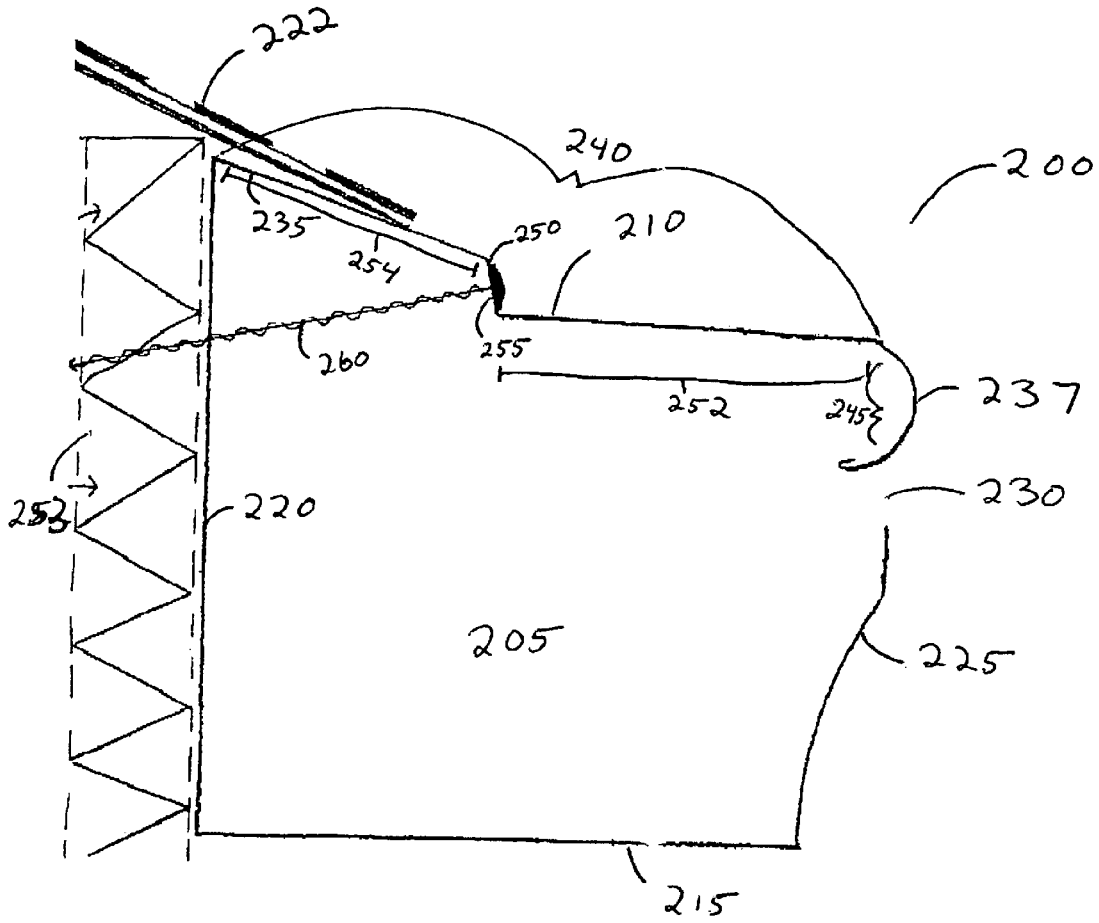
FIG. 3 is a perspective view of the preferred embodiment of the present invention wherein the unique step down portion on the top portion of the protective shield is depicted.

FIG. 3 illustrates the preferred embodiment of the present invention. The rain gutter assembly 200 comprises a one piece, longitudinally extending main body 205 having a shield 210, a floor 215, and a back wall 220 extending between shield 210 and floor 215. The shield includes an interior portion 235 integrally connected to said back wall 220, an exterior edge 237 and a top portion 240. A front wall 225 extends upwardly from floor 215 to define a gutter 200 having a gap 230 between front wall 225 and said exterior edge 237 of shield 210.

Water that is captured in the gutter falls into a downspout (not shown, but known to those of ordinary skill in the art) and is directed away from the building. The interior edge 235, of the gutter shield 210, is preferably installed under at least one row of shingles 222. Water travels down the roof due to the slope thereof and at the end of the shingles the water travels down the gutter shield 210. At the exterior edge 237 of the gutter shield 210 is a curl or bullnose 245, which redirects the water down and back towards the gutter 200, wherein the water falls and is gathered for removal through the downspout. The curl portion (which is also known as a bull-nose section) is well known in the art and is described in the aforementioned patents and are incorporated into the present application in their entirety, in all embodiments and for all purposes.

Debris, such as leaves, and the like, slides off of the gutter shield and beyond the gutter and are therefore excluded from entering the gutter. The gutter is typically attached to a facia board of the building as known in the art. The roof typically comprises a plywood sheet which is overlaid with felt. The manner in which the gutter is attached to the building is not limiting and any of the common methods of attaching a gutter to a building are suitable for demonstrating the present invention.

Significantly, the shield 210 further includes in the present invention a step-down portion 250. The step down portion 250 is formed along the top portion 240 of shield 210; and the vertical section 255 of step down portion 250 is substantially parallel to the back wall 220, which is also typically parallel to the structure 253 on which the gutter is being attached. During installation of the rain gutter of the present invention, the securing means 260 (which can be a nail or screw or the like) is attached through the vertical section 255 of said step down portion 250, through said back wall 220 and into the structure 253. It can be seen in FIG. 3, that the distance between the back wall 220 and the step down portion 250 is significantly less than if the securing means is attached to the exterior edge 237 of the shield 210. This significantly decreases the moment arm (and therefore the length of the securing means) and thereby provides for a much more secure gutter.

Further, as can be seen in FIG. 3, since the securing means 260 is not attached at the exterior edge 237 of the shield 210, it will not interrupt the flow of water over the bull-nose, thereby allowing for better flow into the gutter. Also, since the distance between the roof and the step down portion 250 is less than distance between the roof and the exterior edge 237 of shield 210, it is much easier and safer to install while an installer is situated on the roof. Lastly, regarding installation, since the securing means 260 is located at the step down portion 250 on the top portion 240 of shield 210, it is easier to reach than if an installer needed to reach further down and further out to the exterior edge 237 of shield 210.

Another significant advantage of having a step down portion 250 on top portion 240 of shield 210 is that it helps to pull water away from the roof area and prevent a water backup at the roof. This can be problematic and cause leaks in roofs and disrupt the flow of water through the gutter 200 to the downspout. Since the lower portion 252 of top portion 240 of shield 210 is lower than the higher portion 254 of step down portion 250 of shield 210, gravity pulls it more quickly away from the roof and prevents a back-up of water.

The gutter shield can be manufactured from any of the materials typically used for the manufacture of gutters. The roof gutter assembly can comprise a one piece, longitudinally extending main body (as described above) and the one piece main body can be formed of any standard guttering material including plastic, aluminum, or fiberglass.

During installation of the rain gutter of the present invention, the securing means 260 (which can be a nail or screw or the like) is attached through the vertical section 255 of said step down portion 250, through said back wall 220 and into the structure. It can be seen in FIG. 3 that the distance between the back wall 220 and the step down portion 250 is significantly less than if the securing was at the exterior edge 237 of shield 210.

Figure 4:
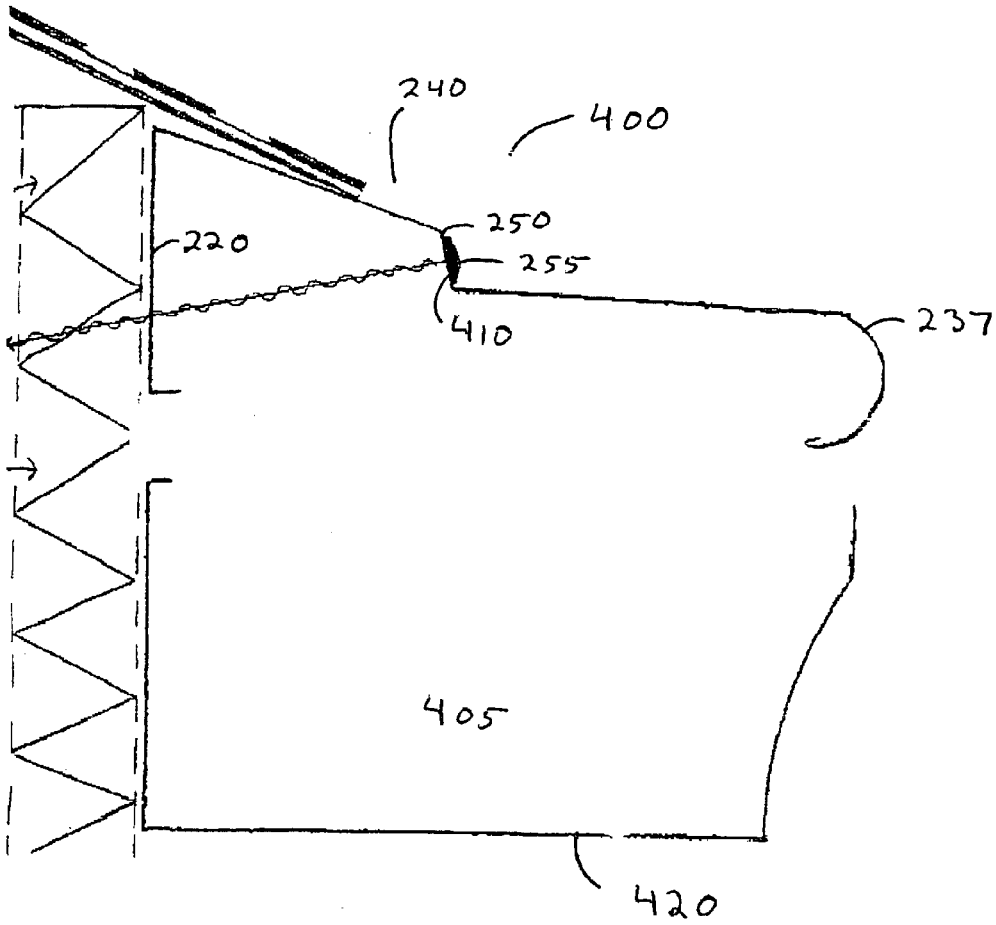
FIG. 4 is a perspective view of a second embodiment of the present invention wherein the shield with a step down section does not have a trough integrally attached thereto, but rather can be placed above a preexisting eaves trough without protection.

FIG. 4 is a perspective view of a second embodiment of the present invention wherein a shield 400 with a step down section 410 does not have a trough integrally attached thereto, but rather can be placed above a pre-existing eaves trough 420 that does not already have protection. The shield 400 is much the same as the shield articulated above as it includes an interior portion 405, however said interior portion is not integrally connected to a back wall but is connected to a back support member positioned above a preexisting eaves trough. Said shield does have, however, an exterior edge 237 and a top portion 240 and further includes at least one step-down portion 250. The at least one step down portion 250 is formed along the top portion 240 and the vertical section 255 of at least one step down portion 250 is substantially parallel to the back support member 220, which is also typically parallel to the structure on which the gutter is being attached. Installation is much the same as above, except that the shield is placed immediately above the pre-existing eaves trough 420.

Figure 5:
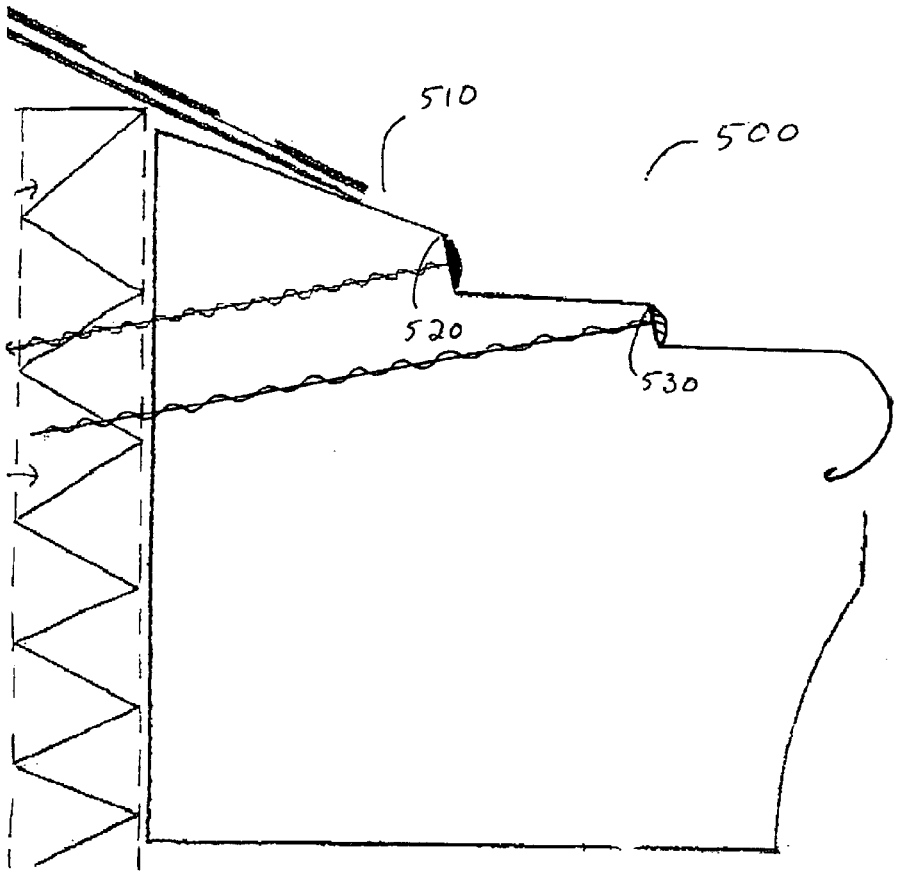
FIG. 5 depicts a third embodiment of the present invention wherein it is shown that the rain gutter can have a shield that has multiple step downs.

FIG. 5 depicts a third embodiment of the present invention wherein it is shown that the rain gutter 500 can have a shield 510 that has multiple step downs. In this embodiment shield 510 has step down 520 and step down 530 immediately below it. This is done so that if more than one connecting means is desired this can be accommodated. It may be desired that more screws are desired for increased structural rigidity or the structure on which the rain gutter 500 is to be placed has unique structural requirements dictating multiple areas for placement of securing means. Further, water flow characteristics may dictate multiple step down portions. The multiple step downs can be used with the first embodiment wherein the rain gutter is a unibody construction or in the second embodiment wherein the trough is not integrally connected to the shield portion.

While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements which embody the spirit and scope of the present invention.

What is claimed is:

1. A gutter system comprising:

a gutter having a trough for receiving water formed by a front wall, a bottom wall and back wall, and a shield, said shield having an exterior edge, a top portion and an interior section integrally formed with a rear wall, said shield covering at least a portion of the trough to prevent debris from entering the trough, and said shield terminating at said exterior edge in a downwardly and rearwardly curved fashion, wherein a gap is provided between a lower end of said downwardly and rearwardly curved section of said shield and the front wall;

wherein said shield has at least one step down portion positioned at point or points on said top portion of said shield; and at least one connecting means for connecting said gutter, said at least one connecting means passing through said at least one step down portion and through connecting means passing through said rear wall into the structure to which it is attached.

2. The gutter system of claim 1 wherein said at least one step down portion is substantially parallel to said rear wall.

3. The gutter system of claim 1 wherein said at least one connecting means is at least one nail inserted through said at least one step down portion and through said rear wall and into said structure to which said gutter is attached.

4. The gutter system of claim 1 wherein said at least one connecting means is at least one screw inserted through said at least one step down portion and through said rear wall and into said structure to which said gutter is attached.

5. A method of attaching a rain gutter to a structure, comprising the steps of:

providing a gutter, said gutter having a trough for receiving water formed by a front wall, a bottom wall and rear wall, and a shield, said shield having an exterior edge, a top portion and an interior section integrally formed with the rear wall, said shield covering at least a portion of the trough to prevent debris from entering the trough, and said shield terminating at said exterior edge in a downwardly and rearwardly curved fashion, wherein a gap is provided between a lower end of said downwardly and rearwardly curved section of said shield and the front wall;

wherein said shield has at least one step down portion positioned at a point or points on said top portion of said shield; and connecting said gutter with at least one connecting means to said structure, said at least one connecting means passing through said at least one step down portion and through said rear wall into the structure to which it is attached.

6. The method of claim 5, wherein said at least one connecting means is at least one nail.

7. The method of claim 5, wherein said at least one connecting means is at least one screw.

8. The method of claim 5, wherein said at least one connecting means is substantially perpendicular to said structure to which said gutter is being attached.

9. The method of claim of claim 5 wherein said structure to which said gutter is attached is a roof and wherein said gutter is attached from a position primarily above said gutter on said roof.

10. A shield for an eaves trough assembly, comprising:

a shield for covering a trough which receives water;

said shield having an exterior edge, a top portion and an interior section, said shield covering at least a portion of the trough to prevent debris from entering the trough, and said shield terminating at said exterior edge in a downwardly and rearwardly curved fashion;

wherein said shield has a step down portion positioned at a point on said top portion of said shield; and a connecting means for securing said shield in a positing above said trough, said connecting means passing through said step down portion and trough said rear wall into the structure to which it is attached.

11. The shield for an eaves trough assembly of claim 10 wherein said step down portion is substantially parallel to said rear wall.

12. The shield for an eaves trough assembly of claim 10 wherein said connecting means is a nail inserted through said step down portion and through said rear wall and into said structure to which said gutter is attached.

13. The shield for an eaves trough assembly of claim 10 wherein said connecting means is a screw inserted through said stop down portion and through said rear wall and into said structure to which said gutter is attached.

14. A method of attaching a shield above a pre-existing rain gutter, comprising the steps of:

providing a shield, said shield having an exterior edge, a top portion and an interior section and covering at least a portion of a trough associated with said rain gutter to prevent debris from entering said trough, and said shield terminating at said exterior edge in a downwardly and rearwardly curved fashion, wherein a gap is provided between a lower end of said downwardly and rearwardly curved section of said shield and a front wall of said trough;

wherein said shield has a step down portion positioned at a point on said top portion of said shield; and connecting said shield with a connecting means to said structure, said connecting means passing through said step down portion and through said rear wall into the structure to which it is attached.

15. The method of claim 14 wherein said connecting means is substantially perpendicular to said structure to which said shield is being attached.

16. The method of claim of claim 14 wherein said structure to which said gutter is attached is a roof and wherein said gutter is attached from a position primarily above said gutter on said roof.

* * * * *